US007972072B2

(12) United States Patent
Toyama et al.

(10) Patent No.: US 7,972,072 B2
(45) Date of Patent: Jul. 5, 2011

(54) RETRACTABLE WRITING IMPLEMENT

(75) Inventors: Matsuhei Toyama, Tokyo (JP); Hisatoshi Shibuya, Tokyo (JP)

(73) Assignee: Zebra Co., Ltd., Tokyo (JP)

( * ) Notice: Subject to any disclaimer, the term of this patent is extended or adjusted under 35 U.S.C. 154(b) by 323 days.

(21) Appl. No.: 12/161,254

(22) PCT Filed: Oct. 18, 2006

(86) PCT No.: PCT/JP2006/320701

§ 371 (c)(1),
(2), (4) Date: Jul. 17, 2008

(87) PCT Pub. No.: WO2007/083424

PCT Pub. Date: Jul. 26, 2007

(65) Prior Publication Data

US 2010/0183356 A1 Jul. 22, 2010

(30) Foreign Application Priority Data

Jan. 19, 2006 (JP) ..... 2006-010897

(51) Int. Cl.
*B43K 5/16* (2006.01)
*B43K 24/02* (2006.01)
*B43K 7/12* (2006.01)

(52) U.S. Cl. ..... 401/112; 401/109; 401/99

(58) Field of Classification Search ..... 401/99, 401/109, 110–115
See application file for complete search history.

(56) References Cited

U.S. PATENT DOCUMENTS 2,928,373 A * 3/1960 Esterow ..... 401/105
4,991,988 A * 2/1991 Snell et al. ..... 401/111
5,413,428 A * 5/1995 Kageyama ..... 401/110
(Continued)

FOREIGN PATENT DOCUMENTS

JP 9-164794 6/1997
(Continued)

OTHER PUBLICATIONS

English language Abstract of JP 2004-17358, Jan. 22, 2004.
English language Abstract of JP 2005-199512, Jul. 28, 2005.
English language Abstract of JP 9-164794, Jun. 24, 1997.
English language Abstract of JP 2004-209881, Jul. 29, 2004.

*Primary Examiner* — Gregory L Huson
*Assistant Examiner* — Keegan Gumbs
(74) *Attorney, Agent, or Firm* — Greenblum & Bernstein P.L.C.

(57) ABSTRACT

To prevent faint writing or writing failure from occurring during a writing operation due to back shock and to reduce shock sound by using a simple structure, a pressure contact member protrudes from one surface or both surfaces on the side of a shaft tube and a knock body so as to come into sliding contact with each other, parts on the side of the shaft tube and the knock body being opposed to each other in a radial direction. Accordingly, even when the part on the side of the knock body retreats with respect to the part on the side of the shaft tube in terms of a releasing operation, a retreat speed of an ink tank becomes slow due to a friction resistance of the pressure contact member, and thus back shock remarkably reduces. As a result, ink does not flow to the ink tank in a reverse direction due to air introduced from a writing tip portion, and shock sound generated when the retreating ink tank returns to a normal position reduces.

6 Claims, 5 Drawing Sheets

U.S. PATENT DOCUMENTS

| | | | | |
|---|---|---|---|---|
| 6,039,484 | A * | 3/2000 | Kageyama et al. | 401/52 |
| 6,089,775 | A * | 7/2000 | Yokouchi | 401/65 |
| 6,280,110 | B2 * | 8/2001 | Lin | 401/106 |
| 2001/0031172 | A1 | 10/2001 | Abe | |
| 2002/0170462 | A1 | 11/2002 | Terai | |

FOREIGN PATENT DOCUMENTS

| | | |
|---|---|---|
| JP | 2004-17358 | 1/2004 |
| JP | 2004-209881 | 7/2004 |
| JP | 2005-199512 | 7/2005 |

* cited by examiner

RETRACTABLE WRITING IMPLEMENT

TECHNICAL FIELD

The present invention relates to a retractable writing implement, for example, a retractable ball pen of which a writing tip portion appears or disappears in terms of a knock operation.

Specifically, the present invention relates to a retractable writing implement for advancing an ink tank in an axial direction so as to allow a writing tip portion to protrude from a front-end opening of a shaft tube by a pressing operation pressing a knock body with respect to the shaft tube and for retreating the ink tank in an axial direction so as to allow the writing tip portion to be inserted into the front-end opening of the shaft tube by a releasing operation.

BACKGROUND ART

In the past, as such a retractable writing implement, there is known a writing implement of which a shaft tube includes a knock body (operation part) configured to be capable of reciprocating in an axial direction; an intermediate member formed in the inner-surface side of the shaft tube so as to be opposed to the knock body; a rotor configured to engage with a cam slope surface of the knock body or a cam slope surface of the intermediate member so as to rotate in a circumferential direction; an urging member configured to urge the rotor backward; and an ink tank (refill) configured to be interlocked with the rotor. When the knock body is pressed, a protrusion of the rotor advances in an axial direction along a slide groove of the intermediate member. Subsequently, the protrusion comes off from the slide groove and rotates so as to slide along the cam slope surface of the knock body. Subsequently, when the knock body returns, the protrusion of the rotor engages with the lock concave portion of the intermediate member so as to be in a locked state. Subsequently, when the knock body is pressed again, the protrusion of the rotor comes off from the lock concave portion of the intermediate member so as to release the locked state, and rotates so as to slide along the cam slope surface of the knock body. Subsequently, the protrusion of the rotor in inserted into the slide groove of the intermediate member, and retreats in an axial direction (for example, see Patent Document 1).

However, according to the known retractable writing implement, since the ink tank is forcedly retreated by the urging member in terms of a releasing operation, a backward shock (hereinafter, referred to as 'back shock') is generated when the ink tank returns to a normal position. Accordingly, air is introduced from a writing tip portion so that ink easily flows to the ink tank in a reverse direction. As a result, faint writing or writing failure may occur during a writing operation.

Particularly, in a case where oil-based ink having low viscosity and low flow resistance is received in the ink tank, a problem arises in that the faint writing or the writing failure easily occurs during the writing operation due to the back shock.

In addition, since shock sound is generated when the retreating ink tank returns to the normal position, and generally the urging force is strongly set in order to surely allow the writing tip portion to appear or disappear, a problem arises in that large shock sound is easily generated when the writing tip portion disappears.

Since a slight gap is formed therebetween in order to reciprocate the knock body in the shaft tube, a part thereof in a circumferential direction come into sliding contact with each other in a surface shape when the knock body reciprocates in terms of the knock operation, and thus slide movement sound is generated. When the rotor rotates with respect to the knock body, bouncing sound or shock sound is generated among the knock body, the rotor, and the intermediate member.

The sounds are generally called knock sound, but since the general knock sound is similar to sharp and high sound 'tick', 'tick', and a knock feeling is light in order to obtain good operability, meaningless knock operations may be continuously repeated to continuously generate the knock sound. Because of a frivolous image together with such a behavior, some persons do not like the retractable writing implement itself.

Since a user himself/herself may use such so-called knock sound to check an operation state (where the writing tip portion appears or disappears), it does not give an unpleasant feeling of course, but may give an unpleasant feeling to other persons. Particularly, during a meeting when the surrounding is silent, a problem arises in that the knock sound in terms of the meaningless knock operations gives an unpleasant feeling to other persons.

Patent Document 1: JP-A-2004-209881 (Pages 6 and 7, FIGS. 1 and 2)

DISCLOSURE OF THE INVENTION

Problem that the Invention is to Solve

The present invention is contrived in consideration of the above-described circumstances, and an object of the invention is to provide a retractable writing implement capable of preventing faint writing or writing failure from occurring during a writing operation due to back shock and of reducing shock sound by using a simple structure.

Means for Solving the Problem

In order to solve the above-described problems, according to a first aspect of the invention, there is provided pressure contact members protruding from one surface or both surfaces of a shaft-tube side and a knock-body side, opposed to each other in a radial direction, so as to come into sliding contact with each other.

Here, 'the shaft-tube side' includes inner components fixed to the inside of the shaft tube in addition to the shaft tube itself, and 'the knock-body side' includes interlocking components reciprocating together with the knock body in addition to the knock body itself.

According to a second aspect of the invention, in addition to the configuration described in the first aspect, the shaft-tube side partly comes into contact with the knock-body side via the pressure contact members.

According to a third aspect of the invention, in addition to the configuration described in the first or second aspect, there is provided bending members configured to elastically deform a portion having the pressure contact members in a radial direction.

According to a fourth aspect of the invention, in addition to the configuration described in the first, second or third aspect, there are provided a rotor configured to be capable of rotating in a circumferential direction and of reciprocating along an intermediate member on the side of the shaft tube in an axial direction with respect to the knock body; and pressure contact members configured to protrude from one surface or both surfaces of the knock body and the rotor, opposed to each other in a radial direction, so as to come into sliding contact with each other.

According to a fifth aspect of the invention, in addition to the configuration described in the first, second, third or fourth aspect, there is provided bending members configured to elastically deform a portion having the pressure contact members in a radial direction.

Advantage of the Invention

With the above-described configurations, the present invention exhibits the following effects and advantages.

According to the first aspect, pressure contact members protrudes from one surface or both surfaces of a shaft-tube side and a knock-body side, opposed to each other in a diameter direction, so as to come into sliding contact with each other. Accordingly, even when the knock-body side retreats with respect to the shaft-tube side in terms of a releasing operation, a retreat speed of an ink tank becomes slow due to a friction resistance of the pressure contact members, and thus back shock remarkably reduces. As a result, ink does not flow to the ink tank in a reverse direction due to air introduced from a writing tip portion, and shock sound generated when the retreating ink tank returns to a normal position reduces.

Accordingly, it is possible to prevent faint writing or writing failure from occurring during a writing operation due to the back shock, and to reduce the shock sound.

Accordingly, when comparing with the conventional art having a problem that the air is introduced from the writing tip portion due to the back shock so that the ink flows to the ink tank in a reverse direction, for example, even in the oil-based ink having low viscosity and small flow resistance, it is possible to ensure a satisfactory ink ejection during the writing operation and to provide such a simple structure at a low cost.

In addition, since large shock sound is not generated when the writing tip portion disappears, it is possible to use the writing implement without giving an unpleasant feeling to other persons.

According to the second aspect, since an appropriate resistant feeling is generated by allowing the shaft-tube side to partly come into contact with the knock-body side via the pressure contact members, even when the knock-body side reciprocates with respect to the shaft-tube side, the slide movement sound generated therebetween reduces and the knock operation feeling becomes soft and gentle.

Accordingly, it is possible to improve the knock operation feeling and the knock slide movement sound with a simple structure.

Accordingly, it is possible to provide the high-quality retractable writing implement at a low cost.

Particularly, in a case where the shaft-tube side partly comes into surface contact with the knock-body side via the pressure contact members, since an axial friction resistance more increases than that when the shaft-tube side partly comes into point contact with the knock-body side via the pressure contact members, a retreat speed of the ink tank becomes slower, and thus it is possible to remarkably reduce the back shock. Accordingly, it is possible to more improve the function for preventing the faint writing or the writing failure from occurring during the writing operation. Additionally, since air hardly enters the writing tip portion, it is possible to more efficiently prevent ink from flowing to the ink tank in a reverse direction. Also, since the shock sound generated when the retreating ink tank returns to a normal position more reduces, it is possible to more reduce the shock sound.

In addition, since the surface contact portion of the pressure contact members can easily change a contact area, it is possible to simply adjust the axial friction resistance and thus to easily obtain the desirable knock operation feeling and the desirable knock slide movement sound.

According to the third aspect, since there is provided the bending members for elastically deforming the portion having the pressure contact members in a radial direction, the pressure contact members comes into sliding contact with the shaft-tube side or the knock-body side under an appropriate pressure state in terms of the elastic deformation of the bending members.

Accordingly, it is possible to minutely adjust a pressure contact force between the shaft-tube side and the knock-body side, and to improve a shock absorption property of the corresponding position.

Particularly, when comparing with a case where a substantially ⊃-shape or U-shape notch is formed so as to surround the pressure contact members, in a case where a pair of slots serving as the bending members extends in an axial direction so as to surround the pressure contact members, it is possible to more easily form the bending members, to more protect the bending members from a shock, and to more maintain an elastic force for a long time.

According to the fourth aspect, since there are provided the rotor configured to be capable of rotating in a circumferential direction and of reciprocating along the intermediate member on the side of the shaft tube in an axial direction with respect to the knock body and the pressure contact members configured to protrude from one surface or both surfaces of the knock body and the rotor, opposed to each other in a radial direction, so as to come into sliding contact with each other, an axial reciprocating motion and a rotation force of the rotor with respect to the knock body are controlled in terms of a friction resistance of the pressure contact members. Accordingly, even when the rotor rotates and reciprocates with respect to the knock body in terms of the knock operation, the knock sound including the shock sound and the bouncing sound generated among the intermediate member, the rotor, and the knock body reduces, and thus the knock sound changes from the sharp and high sound to the soft and gentle sound. Also, the retreat speed of the rotor with respect to the knock body becomes slow due to the friction resistance of the pressure contact members, and thus the back shock of the ink tank more reduces.

Accordingly, it is possible to reduce the knock sound caused by the rotation of the rotor, and to more improve the function for preventing the faint writing or the writing failure from occurring during the writing operation due to the back shock.

Accordingly, even in a meeting when the surrounding is silent, it is possible to comfortably perform the knock operation without giving an unpleasant feeling to other persons.

Particularly, when comparing with a case where the knock body partly comes into point contact with the rotor via the pressure contact members, in a case where the knock body partly comes into surface contact with the rotor via the pressure contact members, since a circumferential or axial friction resistance increases, the axial reciprocating motion and the rotation of the rotor with respect to the knock body is more controlled, and thus it is possible to remarkably reduce the knock sound including the shock sound and the bouncing sound. Also, the back shock of the ink tank more reduces, and thus it is possible to remarkably improve the function for preventing the faint writing or the writing failure from occurring during the writing operation due to the back shock caused by the rotation of the rotor.

In addition, since the surface contact portion of the pressure contact members can easily change a contact area, it is possible to simply adjust the circumferential or axial friction resistance and thus to easily obtain the desirable knock slide movement sound.

According to the fifth aspect, since there is provided the bending members for elastically deforming the portion having the pressure contact members in a radial direction, the pressure contact members comes into sliding contact with the knock body or the rotor under an appropriate pressure state in terms of the elastic deformation of the bending members.

Accordingly, it is possible to minutely adjust a pressure contact force between the knock body and the rotor, and to improve a shock absorption property of the corresponding position.

DESCRIPTION OF THE PREFERRED EMBODIMENTS

Figure 1A:
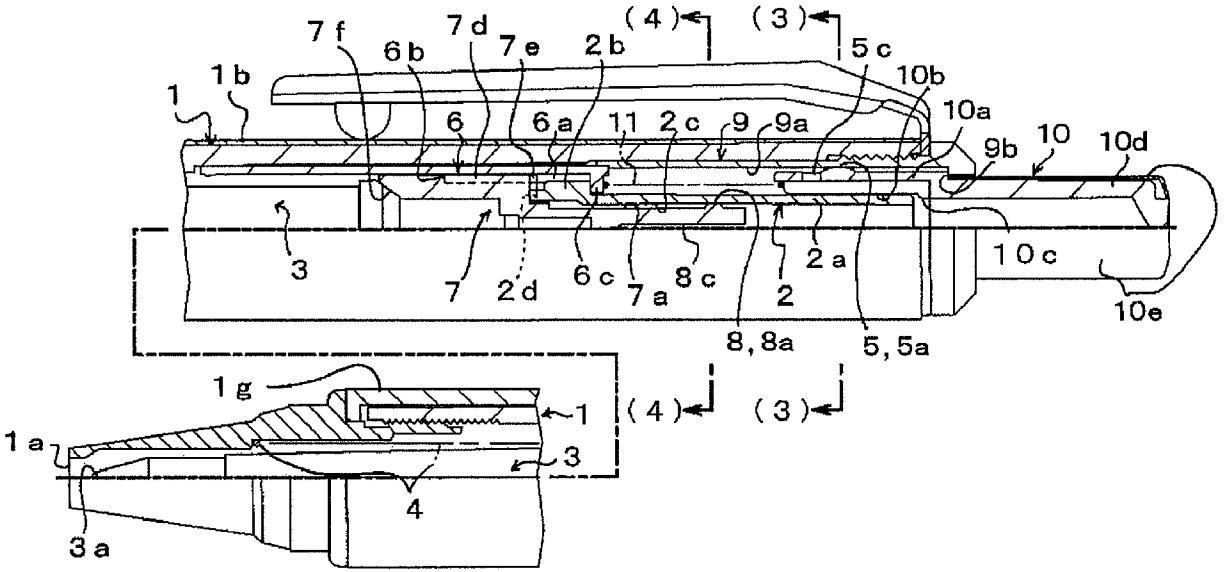
FIG. 1 is a half sectional view showing a retractable writing implement according to a first embodiment in which a part is cut out, where FIG. 1(*a*) shows a case where a writing tip portion is in an inserted state and FIG. 1(*b*) shows a case where the writing tip portion is in a protruding state.

In a retractable writing implement A according to the invention, as shown in FIGS. 1 to 6, as a knock mechanism, a shaft tube 1 is mounted therein with at least a knock body 2 capable of reciprocating in an axial direction of the shaft tube 1, an ink tank 3, and an urging member 4 such as a spring for urging the ink tank 3 backward. When the knock body 2 is pressed, the ink tank 3 advances in an axial direction so that a writing tip portion 3*a* protrudes from a front-end opening 1*a* of the shaft tube 1 and is locked in a state where a writing operation is available. When the lock operation is released by a releasing operation later, the ink tank 3 retreats in an axial direction so as to allow the writing tip portion 3*a* to be inserted into the front-end opening 1*a* of the shaft tube 1.

Then, in a surface in which a part on the side of the shaft tube 1 constituted by the shaft tube 1 or inner components etc. fixed to a position inside the shaft tube 1 are opposed to a part on the side of the knock body 2 constituted by the knock body 2 or interlocking components etc. reciprocating together with the knock body 2 in a radial direction, a pressure contact member 5 protrudes from one surface or both surfaces on the side of the shaft tube 1 and the knock body 2 so as to come into contact with each other. When the pressure contact member 5 comes into sliding contact with the part on the side of the shaft tube 1 and the part on the side of the knock body 2, a friction resistance generated therebetween gives a friction feeling during a knock operation and a reciprocating speed of the part on the side of the knock body 2 with respect to the part on the side of the shaft tube 1 becomes slow.

According to desirable examples of these embodiments, the pressure contact member 5 is configured as a point contact portion 5*a* or a surface contact portion 5*b* in a protruding manner. When the point contact portion 5*a* partly comes into point contact with the part on the side of the shaft tube 1 or the part on the side of the knock body 2 or the surface contact portion 5*b* partly comes into surface contact with the part on the side of the shaft tube 1 or the part on the side of the knock body 2, an appropriate resistant feeling is generated during the knock operation.

As another example, when a slide prevention member (not shown) made from material having a high friction resistance is immovably disposed between the part on the side of the shaft tube 1 and the part on the side of the knock body 2, it is possible to increase a friction resistance in an axial direction.

In addition, it is desirable to be provided with a bending member 5*c* for allowing a portion having the pressure contact member 5 to be elastically deformed in an axial direction.

In a surface in which the knock body 2 constituting the knock mechanism is opposed to a rotor 7 configured to be capable of rotating in a circumferential direction and of reciprocating in an axial direction along an intermediate member 6 on the side of the shaft tube 1 with respect to the knock body 2 in a radial direction, a pressure contact member 8 protrudes from one surface or both surfaces of the knock body and the rotor so as to come into contact with each other. When the pressure contact member 8 comes into sliding contact with the knock body 2 and the rotor 7, a friction resistance generated therebetween controls axial reciprocating motion and a rotation force of the rotor 7 with respect to the knock body 2. Accordingly, it is possible to reduce the knock sound including a bouncing sound and a shock sound generated among the knock body 2, the rotor 7, and the intermediate member 6, and to slow down a retreat speed of the rotor 7 with respect to the knock body 2.

According to desirable examples of these embodiments, when a point contact portion 8*a* of the pressure contact member 8 partly comes into point contact with the knock body 2 and the rotor 7 or a surface contact portion 8*b* thereof comes into surface contact with the knock body 2 and the rotor 7, it is possible to control the axial reciprocating motion and the rotation force of the rotor 7 with respect to the knock body 2.

In addition, it is desirable to be provided with a bending member 8*c* for allowing a portion where the pressure contact member 8 is formed to be elastically deformed in a radial direction.

Hereinafter, the respective embodiments of the invention will be described with reference to the accompanying drawings.

First Embodiment

In the first embodiment, as shown in FIGS. 1 to 4, as the knock mechanism, there is provided the knock body 2, the intermediate member 6 configured to be fixed to a position on the side of the shaft tube 1 so as to be opposed to the knock body 2, and the rotor 7 configured to be capable of rotating in a circumferential direction and of reciprocating in an axial direction with respect to the intermediate member 6. When the knock body 2 is pressed, the rotor 7 advances along the intermediate member 6, and rotates in a circumferential direction so as to be locked in a state where the writing operation is available. When the knock body 2 is pressed again to release the lock state, the rotor 7 retreats along the intermediate member 6 in an axial direction, and a writing tip portion 3*a* is inserted into a front-end opening 1*a* of the shaft tube 1.

In the example shown in the drawing, a clip fixed portion 9 as the inner component is integrally attached to the shaft tube 1 by a screw-connection, and a cylindrical knock cap 10 as the interlocking component reciprocating together with the knock body 2 is axially fitted to a support portion 2*a* formed at a position in rear of the knock body 2. When the pressure contact member 5 is formed in the outer peripheral surface of the knock cap 10 so as to protrude toward an inner surface 9*a* of the clip fixed portion 9, the pressure contact member 5 partly comes into contact with the inner surface 9*a* of the clip fixed portion 9 so that the pressure contact member 5 comes into sliding contact with the inner surface 9*a* of the clip fixed portion 9 under an appropriate pressure state by the pressing operation for pressing the knock body 2.

The knock cap 10 is formed into a cylindrical shape in which a rear-end surface is closed to form a substantial bottom, and a diameter expansion portion 10*a* is formed in the front-end side so as to have a diameter smaller than that of the inner surface 9*a* of the clip fixed portion 9. The point contact portion 5*a* as the pressure contact member 5 is formed at a part of the outer peripheral surface of the diameter expansion portion 10*a* so as to perform a partial point contact.

Figure 2:
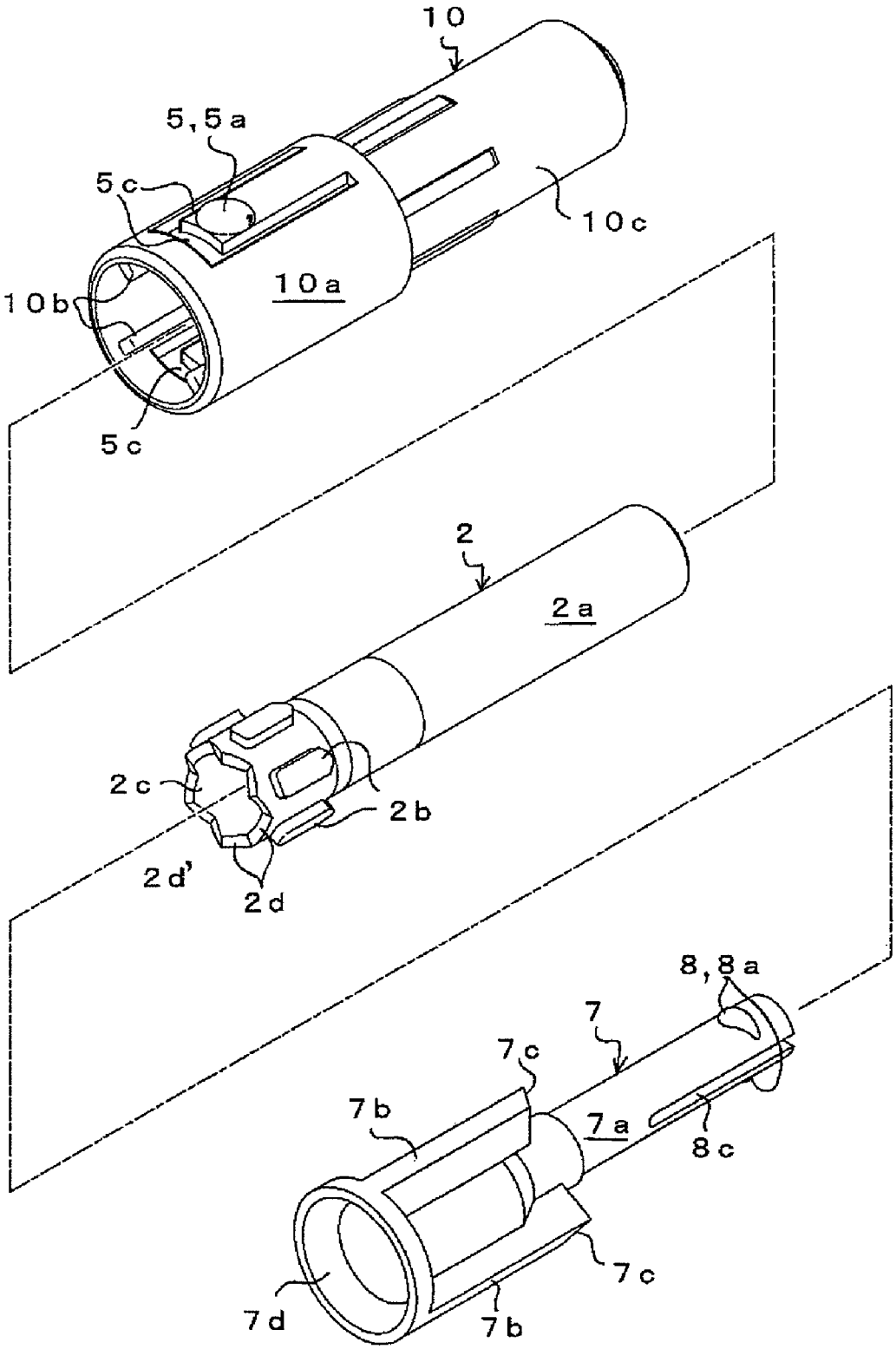
FIG. 2 is an exploded perspective view showing a main part.
Figure 3:
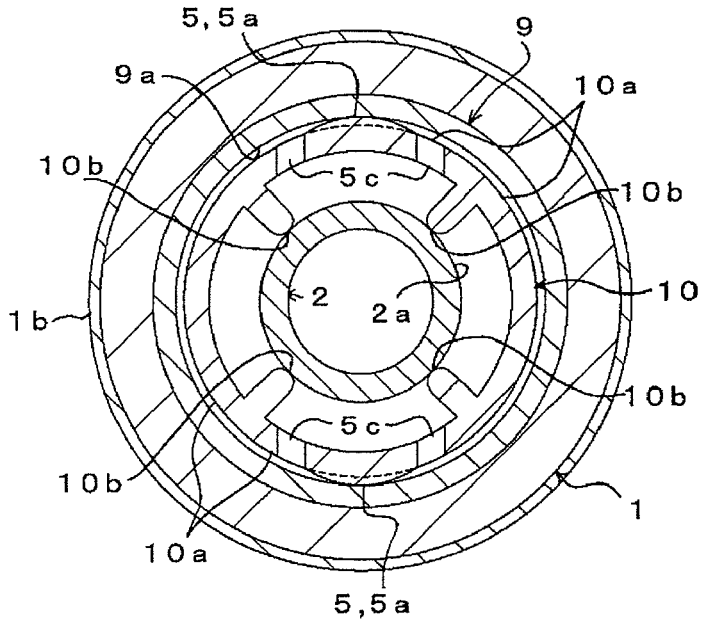
FIG. 3 is a transverse top view taken along the line (3)-(3) in FIG. 1(*a*).
Figure 4:
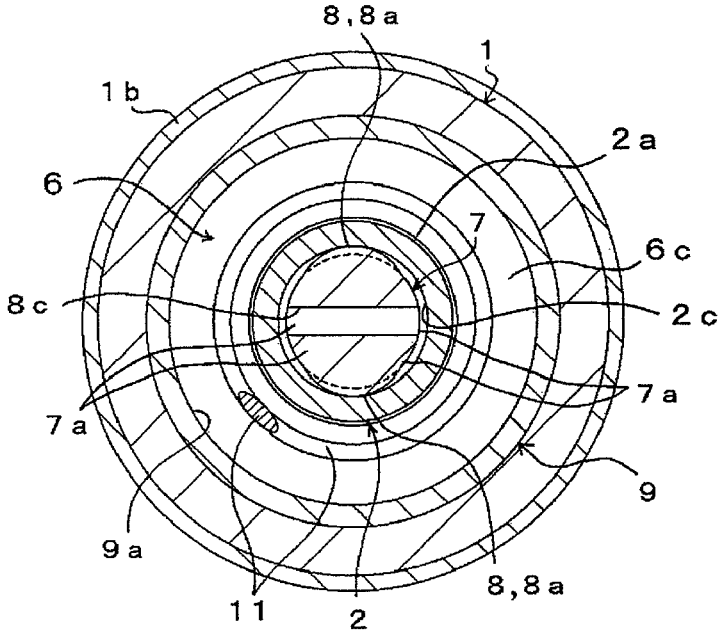
FIG. 4 is a transverse top view taken along the line (4)-(4) in FIG. 1(*a*).

In the example shown in the drawing, as shown in FIG. 2, as the point contact portion 5*a* of the pressure contact member 5, a protrusion is formed into a semispherical shape in a sectional view and is formed at a constant interval in a circumferential direction. However, as another example, two or more point contact portions 5*a* may be formed at a constant interval in a circumferential direction.

In addition, one or both of the front end portion of the point contact portion 5*a* and the inner surface 9*a* of the clip fixed portion 9 may be attached with a slide prevention member (not shown) made from material having a high friction resistance so as not to move in an axial direction, thereby increasing a friction resistance in an axial direction.

As the bending member 5*c* for elastically deforming a portion having the pressure contact member 5 in a radial direction, for example, a substantially ⊃-shape or U-shape notch is formed in the diameter expansion portion 10*a* of the knock cap 10 so as to surround the pressure contact member 5, thereby realizing a structure in which the portion having the pressure contact member 5 is independently and easily deformed in a radial direction in an elastic manner. Accordingly, the diameter expansion portion 10*a* of the knock cap 10 is easily inserted into the clip fixed portion 9 described below and the pressure contact member 5 comes into sliding contact with the inner surface 9*a* of the clip fixed portion 9 under an appropriate pressure state.

As another desirable example of the bending member 5*c*, although it is not shown in the drawing, a pair of slots extending in an axial direction may be formed in a circumferential direction so as to surround the portion having the pressure contact member 5. Alternatively, a pair of slots extending in a radial direction may be formed in an axial direction so that only the portion having the pressure contact member 5 is easily and elastically deformed in a radial direction. Alternatively, a plurality of slots extending in an axial direction may be formed at an appropriate interval in a circumferential direction so that the whole part of the diameter expansion portion 10*a* including the portion having the pressure contact member 5 is easily and elastically deformed in a radial direction.

In addition, a slide portion 10*b* configured to come into contact with a rear-end support portion 2*a* of the knock body 2 described below so as to be opposed thereto in a radial direction, and a press portion 10*c* configured to come into contact with the rear-end support portion 2*a* of the knock body 2 so as to be opposed thereto in an axial direction are provided inside the diameter expansion portion 10*a* of the knock cap 10. When the knock cap 10 is pressed, the knock body 2 advances via the press portion 10*c*, and the whole part of the knock cap 10 is supported by the slide portion 10*b* so as to be capable of reciprocating in an axial direction along the rear-end support portion 2*a* of the knock body 2.

The clip fixed portion 9 is formed of, for example, DURACON (POM), soft synthetic resin or metal and has a cylindrical shape in which at least the inner surface 9*a* is flat and an engagement end portion 9*b* is formed in the rear end of the fixed portion 9 in a protruding manner so as to be opposed to the diameter expansion portion 10*a* of the knock cap 10 in an axial direction. When the diameter expansion portion 10*a* engages with the engagement end portion 9*b* in an axial direction, the whole part of the knock cap 10 is movable backward until the diameter expansion portion 10*a* comes into contact with the engagement end portion 8*b*.

Then, the knock body 2 is formed into a cylindrical shape in which the support portion 2*a* is formed in the rear-end outer peripheral surface so as to fitted to the slide portion 10*b* of the knock cap 10 in a reciprocating manner in an axial direction and a rotation regulation portion 2*b* is formed in the front-end outer peripheral surface so as to engage with a slide portion 6*a* of the intermediate member 6 described below in a protruding manner, thereby being supported by the slide portion 6*a* of the intermediate member 6 so as not to be rotatable and to be movable in an axial direction, and engaging with a stopper 6*c* of the intermediate member 6 described below in an axial direction. Accordingly, the whole part of the knock body 2 is movable backward until the rotation regulation member 2*b* comes into contact with the stopper 6*c*.

A center hole 2*c* having a larger diameter than that of an insertion portion 7*a* of the rotor 7 described below is formed inside the knock body 2 so as to penetrate the inside portion in an axial direction. A cam slope surface 2*d* is formed in the front-end surface of the knock body 2 so as to have a ridge shape continuously formed in a circumferential direction and to be opposed to a cam slope surface 7*c* of the rotor 7 described below.

In the intermediate member 6, a plurality of slide portions 6*a* are formed in the inner side of the shaft tube 1 in a circumferential direction so as to guide the rotation regulation portion 2*b* of the knock body 2 and an engagement portion 7*b* of the rotor 7 in an axial direction. A cam slope surface 6*b* is formed in the front-end surface of the slide portion 6*a* so as to have a ridge shape continuously formed in a circumferential direction to be opposed to the cam slope surface 7*c* of the rotor 7 described below. Also, the stopper 6*c* is formed in the rear end of the slide portion 6*a* in a protruding manner so as to prevent the knock body 2 from moving backward.

If necessary, an elastic member 11 such as a spring may be interposed from the stopper 6*c* to the slide portion 10*b* or the diameter expansion portion 10*a* of the knock cap 10, thereby desirably urging the knock cap 10 backward at a normal time.

The rotor 7 is formed into a substantial cylindrical shape in which the insertion portion 7*a* is formed at a rear-end portion so as to be opposed to the center hole 2*c* of the knock body 2. When the insertion portion 7*a* is inserted into the center hole 2*c* of the knock body 2, the rotor 7 is supported thereto so as to be capable of reciprocating in an axial direction and of rotating in an axial direction. When the point contact portion 8*a* as the pressure contact member 8 is formed in the outer peripheral surface of the insertion portion 7*a* so as to protrude toward the center hole 2*c* of the knock body 2, the point contact portion 8*a* of the pressure contact member 8 partly comes into contact with the center hole 2*c* of the knock body 2, thereby controlling the axial reciprocating motion and the rotation force of the rotor 7 with respect to the knock body 2.

In the example shown in the drawing, as shown in FIG. 2, as the point contact portion 8*a* of the pressure contact member 8, the protrusions having a circular arc shape in a sectional view and extending in a circumferential direction are formed at a constant interval in a circumferential direction. However, as another example, two or more point contact portions 8*a* may be formed at a constant interval in a circumferential direction.

In addition, one or both of the front end portion of the point contact portion 8*a* and the center hole 2*c* of the knock body 2 may be attached with a slide prevention member (not shown) made from material having a high friction resistance so as not to move in an axial direction and a circumferential direction, thereby increasing a friction resistance in an axial direction and a circumferential direction.

As the bending member 8*c* for elastically deforming the portion having the pressure contact member 8 in a radial direction, a concave slot is formed in the outer peripheral surface of the insertion portion 7*a* of the rotor 7 so as to extend to the center of the insertion portion 7*a* in an axial direction, thereby realizing a structure capable of being elastically deformed in a radial direction. Accordingly, the insertion portion 7*a* of the rotor 7 is easily inserted into the center hole 2*c* of the knock body 2, and the pressure contact member 8 comes into sliding contact with the inner peripheral surface of the center hole 2*c* under an appropriate pressure state.

As another desirable example of the pressure contact member 8, although it is not shown in the drawing, one or both of the outer peripheral surface of the insertion portion 7*a* of the rotor 7 and the inner peripheral surface of the center hole 2*c* of the knock body 2 may be mounted with an annular elastic member made from elastically deformable material so as not to move in an axial direction, thereby realizing a structure capable of being elastically deformed in a radial direction.

In addition, a plurality of engagement portions 7*b* are formed at a front-end portion of the rotor 7 in a circumferential direction so as to be fitted to the slide portion 6*a* of the intermediate member 6 in a movable manner in an axial direction. The cam slope surface 7*c* is formed in the rear-end surface of the engagement portion 7*b* so as to comes into sliding contact with the cam slope surface 2*d* of the knock body 2 and the cam slope surface 6*b* of the intermediate member 6. A concave insertion mounting portion 7*d* is formed in the front-end surface of the engagement portion so as to hold the rear end of the ink tank 3 described below in a detachable manner.

Figure 1B:
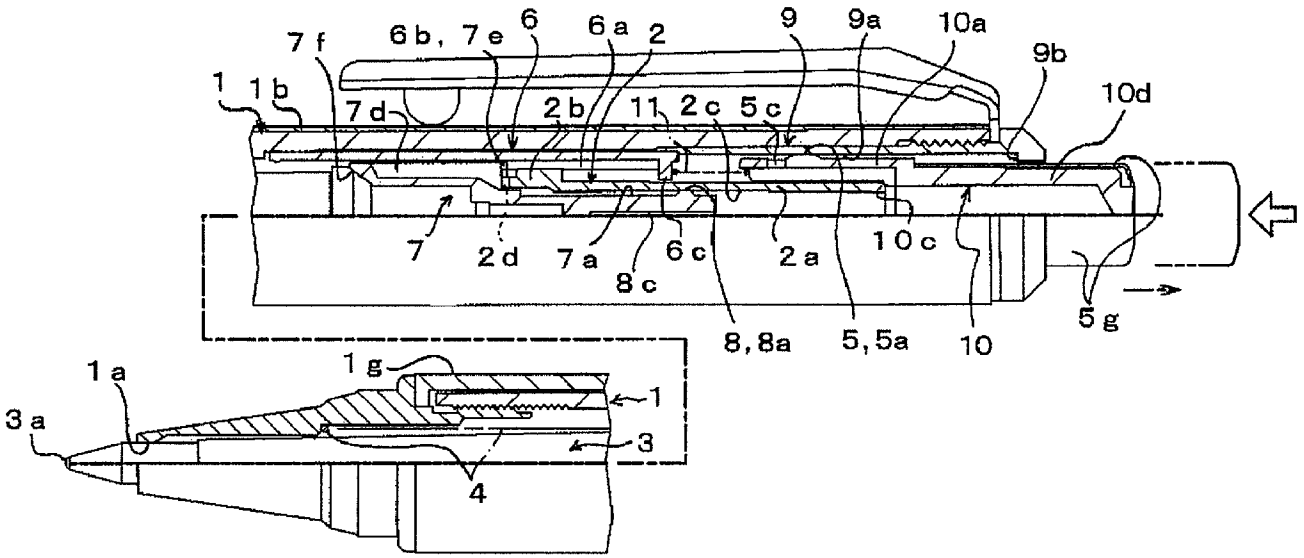

Meanwhile, in the example shown in the drawing, as shown in FIG. 1, the retractable writing implement A according to the invention is a retractable ball pen of which the writing tip portion 3*a* of the ink tank 3 protrudes from or is inserted into the front-end opening 1*a* of the shaft tube 1 in terms of a pressing operation for pressing the knock body 2, and a grip portion (grip) 1*g* is mounted to the front-end outer periphery of the shaft tube 1.

In addition, in the example shown in the drawing, decoration covers 1*b* and 10*e* are respectively mounted to the outer peripheral surface of the shaft tube 1 and the rear-end outer peripheral surface 10*d* of the knock cap 10 so as to cover them. However, instead of mounting the decoration covers 1*b* and 10*e* thereto, the outer peripheral surface of the shaft tube 1 or the rear-end outer peripheral surface 10*d* of the knock cap 10 may be exposed.

Next, an operation of the retractable writing implement A will be described.

First, when the knock body 2 is pressed via the knock cap 10 in a state where the writing tip portion 3*a* of the ink tank 3 is inserted in the front-end opening 1*a* of the shaft tube 1 shown in FIG. 1(*a*), the cam slope surface 2*d* of the knock body 2 comes into contact with the cam slope surface 7*c* of the rotor 7 so that the rotor 7 is directly pressed to advance.

At this time, since the pressure contact member 5 of the knock cap 10 on the side of the knock body 2 slides along the inner surface 9*a* of the clip fixed portion 9 on the side of the shaft tube 1 while partly coming into point contact with each other, an appropriate resistance feeling can be given to the reciprocating motion of the knock cap 10 with respect to the clip fixed portion 9, that is, the knock operation.

Accordingly, even when the knock cap 10 on the side of the knock body 2 reciprocates with respect to the clip fixed portion 9 on the side of the shaft tube 1, a slide movement sound generated therebetween reduces, and a knock operation feeling becomes smooth and gentle, thereby improving the knock slide movement sound and the knock operation feeling.

By the pressing operation of the cam slope surface 2*d* of the knock body 2, the engagement portion 7*b* of the rotor 7 advances along the slide portion 6*a* of the intermediate member 6, and then the engagement portion 7*b* of the rotor 7 comes off from the slide portion 6*a*.

At this time, the whole part of the rotor 7 is opened to be in a free state, and the knock sound is generated among the knock body 2, the rotor 7, and the intermediate member 6 by a subsequent operation.

Specifically, since the cam slope surface 7*c* of the rotor 7 being in the free state slides along the cam slope surface 2*d* of the knock body 2 to rotate, the knock sound is generated until the rotation is stopped after the engagement portion 7*b* of the rotor 7 coming off from the slide portion 6*a* of the intermediate member 6 slides along the cam slope surface 2*d* and enters a final-end concave portion 2*d*'.

In this case, it may be thought that the knock sound is generated as a bouncing sound 'tick' only when the cam slope surface 7*c* of the rotor 7 bounces against the front end of the slide portion 6*a* of the intermediate member 6 and/or comes into contact with the final-end concave portion 2*d*' of the cam slope surface 2*d*.

Subsequently, when the one-time pressing operation of the knock body 2 ends, the knock body 2 and the rotor 7 return backward by an urging force of the urging member 4, and thus the cam slope surface 7*c* of the rotor 7 slides along the cam slope surface 6*b* of the intermediate member 6 so as to further rotate and be locked in a contact state.

Accordingly, as shown in FIG. 1(*b*), the writing tip portion 3*a* of the ink tank 3 is maintained to protrude from the front-end opening 1*a* of the shaft tube 1.

When the cam slope surface 7*c* of the rotor 7 is locked to the cam slope surface 6*b* of the intermediate member 6 in a contact state, the knock sound is generated.

In this case, it may be thought that the knock sound is generated as a shock sound 'tick' when the cam slope surface 7*c* of the rotor 7 comes into contact with a final-end concave portion (not shown) of the cam slope surface 6*b* of the intermediate member 6.

However, in the retractable writing implement A according to the invention, since the pressure contact member 8 of the rotor 7 slides along the center hole 2*c* of the knock body 2 in a contact state, an appropriate friction resistance of the pressure contact member 8 is used to control the axial reciprocating motion and the rotation force of the rotor 7.

Accordingly, even when the rotor 7 rotates and reciprocates with respect to the knock body 2 in terms of the knock operation, it is possible to reduce the bouncing sound generated when the cam slope surface 7*c* of the rotor 7 bounces against the front end portion of the slide portion 6*a* of the intermediate member 6 and/or comes into contact with the final-end concave portion 2*d*' of the cam slope surface 2*d* and the shock sound generated when the cam slope surface 7*c* of the rotor 7 comes into contact with the final-end concave portion (not shown) of the cam slope surface 6*b* of the intermediate member 6. Also, it is possible to reduce the knock sound generated by the rotation of the rotor 7 because the knock sound having the bouncing sound and the shock sound changes from a sharp and high sound to a smooth and gentle sound.

Then, in the knock operation for retreating the ink tank 3 later, the cam slope surface 7*c* of the rotor 7 comes off from the final-end concave portion of the cam slope surface 6*b* of the intermediate member 6 upon advancing the cam slope surface 2*d* of the knock body 2. Accordingly, when the rotor 7 slides along the cam slope surface 2*d* of the knock body 2 to rotate, the knock sound (bouncing sound) is generated from the rotor 7 being in the free state. Subsequently, when the engagement portion 7*b* of the rotor 7 enters the slide portion 6*a* of the intermediate member 6, the knock sound (shock sound) is generated.

However, as described above, since the pressure contact member 8 of the rotor 7 slides along the center hole 2*c* of the knock body 2 in a contact state so that the appropriate friction resistance of the pressure contact member 8 controls the axial reciprocating motion and the rotation force of the rotor 7 with respect to the knock body 2, the knock sound (bouncing sound and shock sound) reduces. Also, since the knock sound changes from the sharp and high sound to the soft and gentle sound, the knock sound generated by the rotation of the rotor 7 reduces.

In addition, when the ink tank 3 retreats, since the pressure contact member 5 of the knock cap 10 on the side of the knock body 2 slides along the inner surface 9*a* of the clip fixed portion 9 on the side of the shaft tube 1 while partly coming into point contact with each other, a retreat speed of the ink tank 3 becomes slow due to the friction resistance of the pressure contact member 5, and thus a back shock (backward shock) with respect to the ink tank 3 remarkably reduces.

Accordingly, since ink does not flow to the ink tank 3 in a reverse direction due to air introduced from the writing tip portion 3*a*, it is possible to prevent faint writing and writing failure from occurring during a writing operation due to the back shock, with a simple structure.

Further, since a retreat speed of the rotor 7 with respect to the knock body 2 becomes slower by the friction resistance of the pressure contact member 8 of the rotor 7, it is possible to more reduce the back shock of the ink tank 3 and to more improve a function for preventing the faint writing and the writing failure from occurring during the writing operation due to the back shock.

Furthermore, when the knock cap 10 is urged backward at a normal time by interposing the elastic member 11 such as the spring between the intermediate member 6 and the knock cap 10 like the example shown in the drawing in a state where the writing tip portion 3*a* of the ink tank 3 shown in FIG. 1(*b*) is maintained to protrude from the front-end opening 1*a* of the shaft tube 1 so that the writing operation is available, the diameter expansion portion 10*a* retreats until coming into contact with the engagement end portion 9*b* of the clip fixed portion 9 so as to maintain the rear-end outer peripheral surface 10*d* in a protruding state.

Accordingly, it is advantageous in that the knock cap 10 does not clatter in an axial direction even in a state where the knock body 2 advances.

Second Embodiment

Figure 5A:
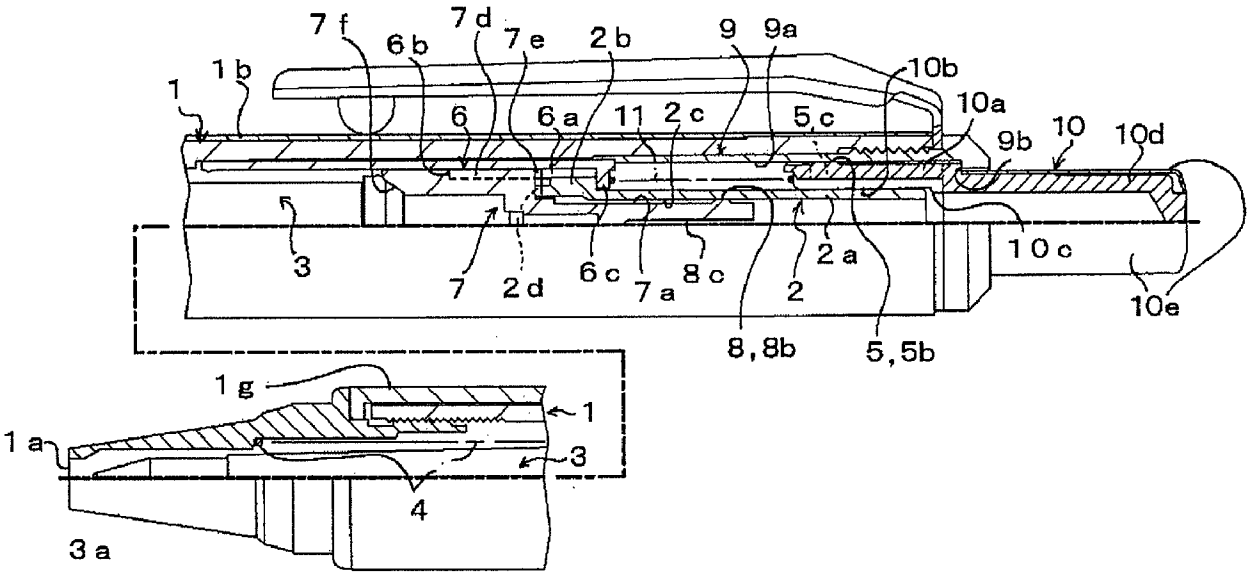
FIG. 5 is a half sectional view showing the retractable writing implement according to a second embodiment in which a part is cut out, where FIG. 5(*a*) shows a case where the writing tip portion is in an inserted state and FIG. 5(*b*) shows a case where the writing tip portion is in a protruding state.
Figure 5B:
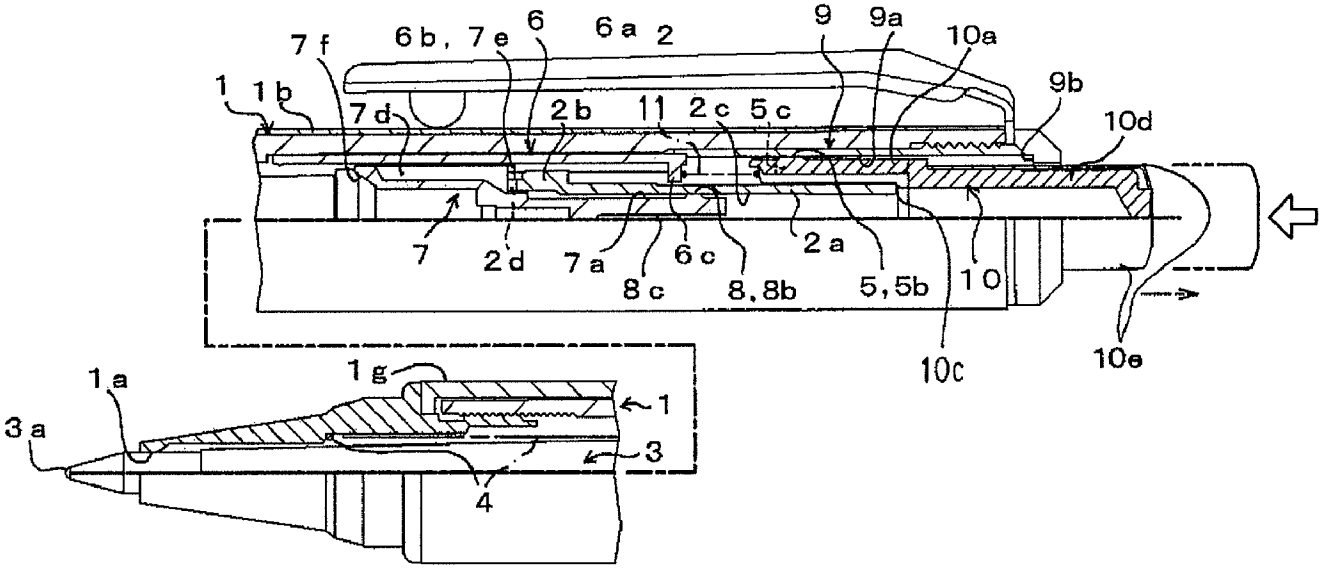
Figure 6:
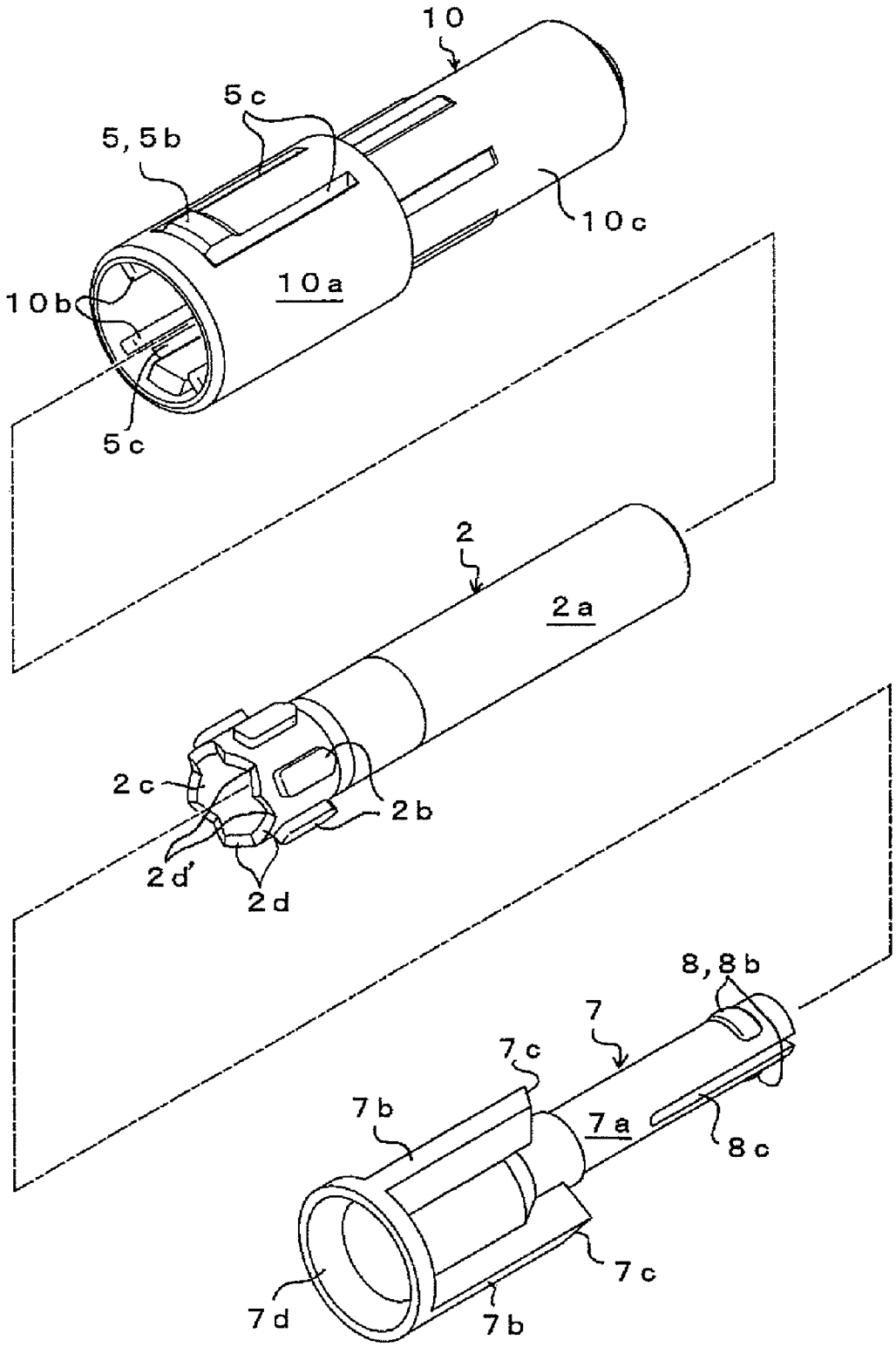
FIG. 6 is an exploded perspective view showing a main part.

In the second embodiment, as shown in FIGS. 5 and 6, a configuration in which the surface contact portion 5*b* as the pressure contact member 5 is formed in the outer peripheral surface of the diameter expansion portion 10*a* of the knock cap 10 so as to protrude toward the inner surface 9*a* of the clip fixed portion 9 and to perform a partial surface contact and the surface contact portion 8*b* as the pressure contact member 8 is formed in the outer peripheral surface of the insertion portion 7*a* of the rotor 7 so as to protrude toward the center hole 2*c* of the knock body 2 is different from that of the first embodiment shown FIGS. 1 to 4, and other configurations are the same as those of the first embodiment shown in FIGS. 1 to 4.

In the example shown in the drawing, as the surface contact portion 5*b* of the pressure contact member 5, a pair of protrusions are formed at a constant interval in a circumferential direction so as to have a trapezoid shape in a sectional view in an axial direction and a substantially slightly elongated rectangular shape when viewing from its surface in a circumferential direction.

As another example, the surface shape of the surface contact portion 5*b* may be formed into a substantially circular shape or oval shape instead of the rectangular shape. Alternatively, three or more surface contact portions 5*b* may be formed at a constant interval in a circumferential direction or may be substantially formed in a continuous manner in a circumferential direction. Alternatively, one or both of the front-end surface and the inner surface 9*a* of the clip fixed portion 9 may be attached with a slide prevention member (not shown) made from material having a high friction resistance so as not to move in an axial direction, thereby increasing a friction resistance in an axial direction.

In addition, as the bending member 5*c* for elastically deforming a portion having the surface contact portion 5*b* in a radial direction, a pair of slots extending in an axial direction is formed so as to interpose the portion having the surface contact portion 5*b* therebetween in a circumferential direction.

As another example, for example, a substantially ⊃-shape or U-shape notch may be formed so as to surround the portion having the surface contact portion 5*b*.

In addition, as the surface contact portion 8*b* of the pressure contact member 8, a pair of protrusions is formed at a constant interval in a circumferential direction so as to have a trapezoid shape in a sectional view in an axial direction and a substantially slightly elongated rectangular shape when viewing from its surface in a circumferential direction.

As another example, the surface shape of the surface contact portion 8*b* may be formed into a substantially oval shape instead of the rectangular shape. Alternatively, three or more surface contact portions 8*b* may be formed at a constant interval in a circumferential direction or may be substantially formed in a continuous manner in a circumferential direction. Alternatively, one or both of the front-end surface and the center hole 2*c* of the knock body 2 may be attached with a slide prevention member (not shown) made from material having a high friction resistance so as not to move in an axial direction, thereby increasing a friction resistance in an axial direction.

Accordingly, in the second embodiment shown in FIGS. 5 and 6, since a friction resistance of the point contact portion 5*a* of the pressure contact member 5 or the point contact portion 8*a* of the pressure contact member 8 in an axial direction or a circumferential direction more increases than that of the first embodiment shown in FIGS. 1 to 4, the axial reciprocating motion and the rotation force of the rotor 7 with respect to the knock body 2 is more controlled, and thus it is possible to remarkably reduce the knock sound having the bouncing sound and the shock sound. Also, the retreat speed of the ink tank 3 becomes slower, and thus it is possible to remarkably reduce the back shock. In accordance with the reduction of the back shock, it is possible to more improve a function for preventing faint writing and writing failure from occurring during the writing operation. Additionally, it is advantageous in that it is possible to more efficiently prevent ink from flowing to the ink tank 3 in a reverse direction because it is more difficult for air to enter the writing tip portion, and it is possible to more reduce the shock sound because it is possible to more reduce the shock sound generated when the retreating ink tank 3 returns to a normal position.

In addition, since the area of the surface contact portion 5*b* or the surface contact potion 8*b* can be easily changed, it is possible to control the friction resistance in an axial direction or a circumferential direction. Accordingly, it is advantageous in that it is possible to easily obtain the desirable knock sound having the knock slide movement sound, the bouncing sound, and the shock sound and the desirable knock operation feeling.

As the bending member 5*c* for elastically deforming the portion having the pressure contact member 5 in a radial direction, the pair of slots extends in an axial direction by interposing the surface contact portion 5*b* of the pressure contact member 5 therebetween in a radial direction. Accordingly, it is advantageous in that it is possible to more easily form the slots, to more protect the slots against the shock, and to more maintain the elastic force of the slots for a long time than the substantially ⊃-shape or U-shape notch of the first embodiment shown in FIGS. 1 to 4.

Although the exemplary embodiments have described about a case where the ink tank 3 retreats in an axial direction by pressing the knock body 2 in a state where the writing operation is available so that the writing tip portion 3*a* is inserted into the front-end opening 1*a* of the shaft tube 1, the invention is not limited thereto, but may be configured as other structures instead of the structure shown in the drawing, so long as the ink tank 3 can be retreated in terms of a releasing operation for pressing, for example, a side knock member provided in an outer surface of the shaft tube 1 so that the wring tip portion 3*a* is inserted into the front-end opening.

Although the above-described embodiments have described about a case where the pressure contact member 5 is formed in the outer peripheral surface of the knock cap 10 reciprocating together with the knock body 2 so as to protrude toward the inner surface 9*a* of the clip fixed portion 9 on the side of the shaft tube 1, the invention is not limited thereto, but may be configured as other structures in which the pressure contact member 5 is formed in other interlocking components (not shown) instead of the knock body 2 or the knock cap 10 reciprocating together with the knock body 2 in a protruding manner toward the shaft tube 1, the pressure contact member 5 is formed in a part on the side of the shaft tube 1 including the inner components such as the clip fixed portion 9 fixed to the shaft tube 1 or the inside thereof in a protruding manner toward a part on the side of the knock body 2 including the interlocking components such as the knock body 2 or the knock cap 10 reciprocating together with the knock body 2 so as to come into sliding contact with each other, or the pressure contact members 5 are formed in the parts on both sides of the shaft tube 1 and the knock body 2 in a protruding manner so as to come into sliding contact with each other.

In the same way, although the pressure contact member 8 is formed in the outer peripheral surface of the rotor 7 so as to protrude toward the center hole 2*c* of the knock body 2, the invention is not limited thereto, but may be configured as other structures in which the pressure contact member 8 is formed in a part on the side of the center hole 2*c* of the knock body 2 in a protruding manner toward the outer peripheral surface of the rotor 7 or the pressure contact members 8 are formed on the parts on both sides of the rotor 7 and the knock body 2 in a protruding manner so as to come into sliding contact with each other.

Although the example shown in the drawing has described about a case where the retractable writing implement A according to the invention is the retractable ball pen mounted with the ink tank 3 as a refill, the invention is not limited thereto, but may be applied to a writing implement disclosed in, for example, JP-A-H10-166781 and having an ink guide structure for supplying the ink within the ink tank 3 to the writing tip portion in terms of a capillary force (ink suction force), a felt-tipped pen, and the like if there is a problem that the faint writing or the writing failure occurs during the writing operation due to the back shock.

The invention claimed is:

1. A retractable writing implement for advancing an ink tank in an axial direction so as to allow a writing tip portion to protrude from a front-end opening of a shaft tube by a pressing operation pressing a knock body with respect to the shaft tube and for retreating the ink tank by a releasing operation, the retractable writing implement comprising:

a clip fixed portion forming an inner component of the shaft tube;

a cylindrical knock cap axially fitted to the exterior of the knock body and reciprocating with the knock body;

first pressure contact members projecting toward an inner surface of the clip fixed portion from an outer surface of the knock cap, opposed to each other in a radial direction, so as to come into sliding contact with the inner surface of the clip fixed portion under pressure; and first bending members configured to elastically deform a portion having the first pressure contact members in a radial direction.

2. The retractable writing implement according to claim 1, wherein the clip fixed portion partly comes into contact with the knock body side via the first pressure contact members.

3. The retractable writing implement according to claim 1, further comprising:

a rotor configured to be capable of rotating in a circumferential direction and of reciprocating along an intermediate member on the side of the shaft tube in an axial direction with respect to the knock body, and second pressure contact members projecting from an outer surface of the rotor, opposed to each other in a radial direction, so as to come into sliding contact with an inner surface of the knock body under pressure.

4. The retractable writing implement according to claim 2, further comprising:

a rotor configured to be capable of rotating in a circumferential direction and of reciprocating along an intermediate member on the side of the shaft tube in an axial direction with respect to the knock body, and second pressure contact members projecting from an outer surface of the rotor, opposed to each other in a radial direction, so as to come into sliding contact with an inner surface of the knock body under pressure.

5. The retractable writing implement according to claim 3, further comprising:

second bending members configured to elastically deform a portion having the second pressure contact members in a radial direction.

6. The retractable writing implement according to claim 4, further comprising:

second bending members configured to elastically deform a portion having the second pressure contact members in a radial direction.

* * * * *